US008500579B1

(12) United States Patent
Long et al.

(10) Patent No.: US 8,500,579 B1
(45) Date of Patent: Aug. 6, 2013

(54) CROSSBOW BOLT OR ARROW SYSTEM FOR ENHANCING WOUNDS

(76) Inventors: Todd M. Long, Nebo, KY (US); Steven Brady, Hamberg, PA (US)

( * ) Notice: Subject to any disclaimer, the term of this patent is extended or adjusted under 35 U.S.C. 154(b) by 0 days.

(21) Appl. No.: 13/233,464

(22) Filed: Sep. 15, 2011

(51) Int. Cl.
*F42B 6/04* (2006.01)

(52) U.S. Cl.
USPC ..... 473/578; 473/586

(58) Field of Classification Search
USPC ..... 473/583, 585, 586, 578
See application file for complete search history.

(56) References Cited

U.S. PATENT DOCUMENTS

D185,249 S 5/1959 Wampfler
4,266,782 A * 5/1981 Patterson ..... 473/586
4,277,069 A 7/1981 Rouse
4,380,340 A 4/1983 Simo
4,534,568 A * 8/1985 Tone ..... 473/583
5,119,797 A * 6/1992 Anderson ..... 124/25
6,186,913 B1 2/2001 Thomas
6,238,310 B1 5/2001 Morrison
6,669,585 B2 12/2003 Sutherland et al.
6,695,727 B1 * 2/2004 Kuhn ..... 473/586
6,705,808 B2 3/2004 Kane

* cited by examiner

*Primary Examiner* — John Ricci

(57) ABSTRACT

A bolt-arrow system having a shaft with a first end and a second end, an arrowhead component having a pointed end and a shaft end, the shaft end removably engages the first end of the shaft, a fletch head having a shaft end and a back end, the shaft end removably engages the second end of the shaft, and a plurality of fletchings extending outwardly from the fletch head, the fletchings each comprise a sharp edge.

1 Claim, 3 Drawing Sheets

(Side View)

(Exploded View)

(Side View)

(Top View)

(Front View)

(Cross-sectional View)

(In use View

CROSSBOW BOLT OR ARROW SYSTEM FOR ENHANCING WOUNDS

FIELD OF THE INVENTION

The present invention is directed to a hunting weapon, more particularly to a hunting bolt or arrow for creating enhanced wounds.

BACKGROUND OF THE INVENTION

Hunting is a very popular sport. The present invention features a novel bolt system (e.g., bolt or arrow for crossbow). The system of the present invention produces a larger wound in the animal and better blood flow, thus reducing the kill time and helping to reduce the animal's suffering. The enhanced blood flow caused by the bolt system of the present invention also helps the hunter quickly and easily find the animal.

SUMMARY

The present invention features a crossbow bolt (or arrow) system for enhancing wounds. In some embodiments, the bolt system comprises a shaft having a first end and a second end, an arrowhead component having a pointed end and a shaft end, the shaft end removably engages the first end of the shaft via a first attachment means; a fletch head having a shaft end and a back end, the shaft end removably engages the second end of the shaft via a second attachment means; and a plurality of fletchings extending outwardly from the fletch head, the fletchings each comprise a sharp edge.

In some embodiments, the arrowhead component comprises a field point head. In some embodiments, the arrowhead component comprises a broadhead.

In some embodiments, the first attachment means comprises a screw mechanism, a snap mechanism, a clasp mechanism, a magnet mechanism, a screw mechanism, a latch mechanism, the like, or a combination thereof. In some embodiments, a male threaded component is disposed on the shaft end of the arrowhead component and a female threaded component is disposed in the first end of the shaft, wherein the male threaded component is adapted to removably engage the female threaded component.

In some embodiments, the second attachment means comprises a screw mechanism, a snap mechanism, a clasp mechanism, a magnet mechanism, a screw mechanism, a latch mechanism, the like, or a combination thereof. In some embodiments, a male threaded component is disposed on the shaft end of the fletch head and a female threaded component is disposed in the second end of the shaft, wherein the male threaded component is adapted to removably engage the female threaded component.

In some embodiments, the fletch head comprises three fletchings. In some embodiments, the fletchings are constructed from a material comprising titanium. In some embodiments, the fletchings are constructed from a material comprising plastic. In some embodiments, the system further comprises a nock disposed on the back end of the fletch head.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
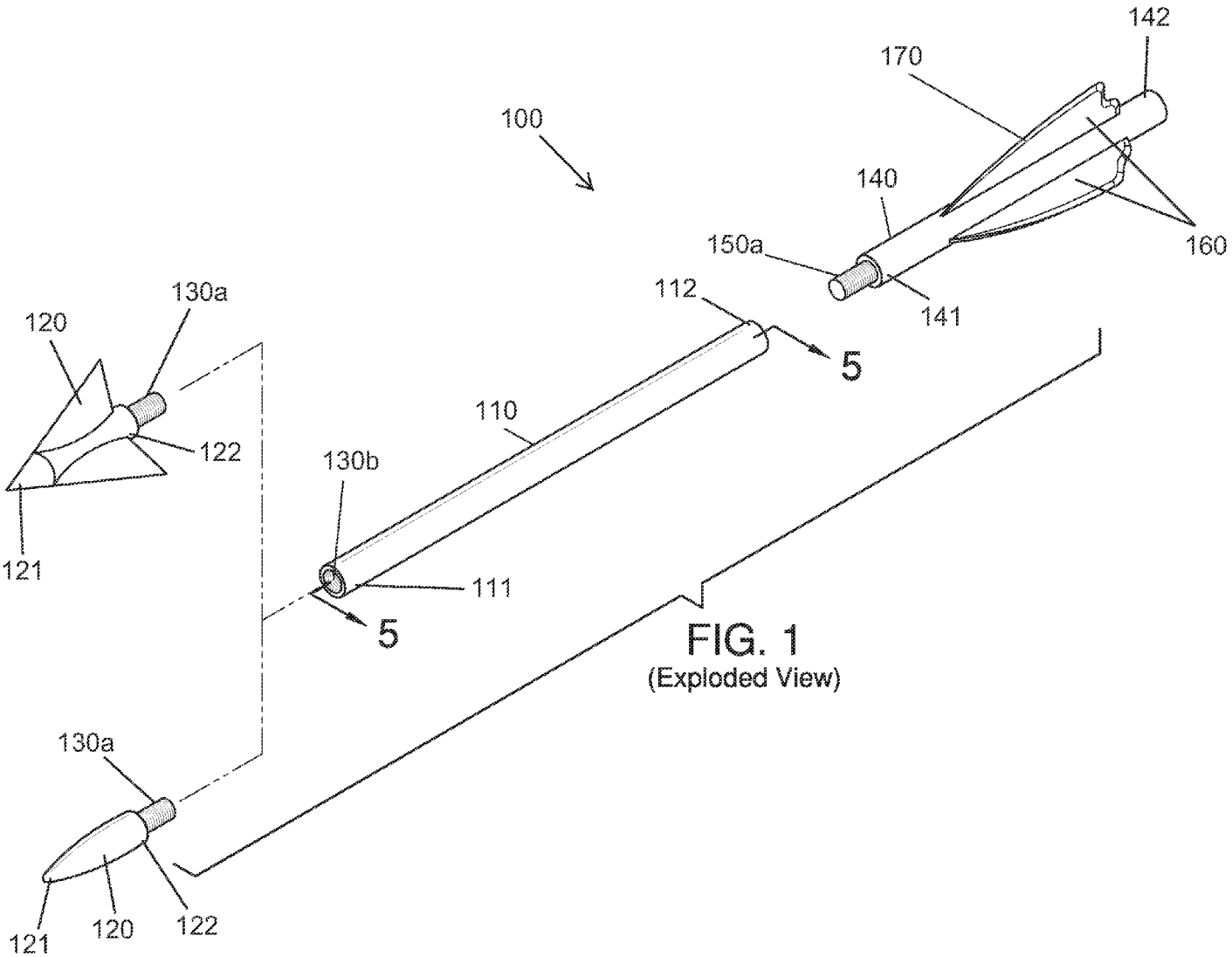
FIG. 1 is an exploded view of the system of the present invention.
Figure 2:
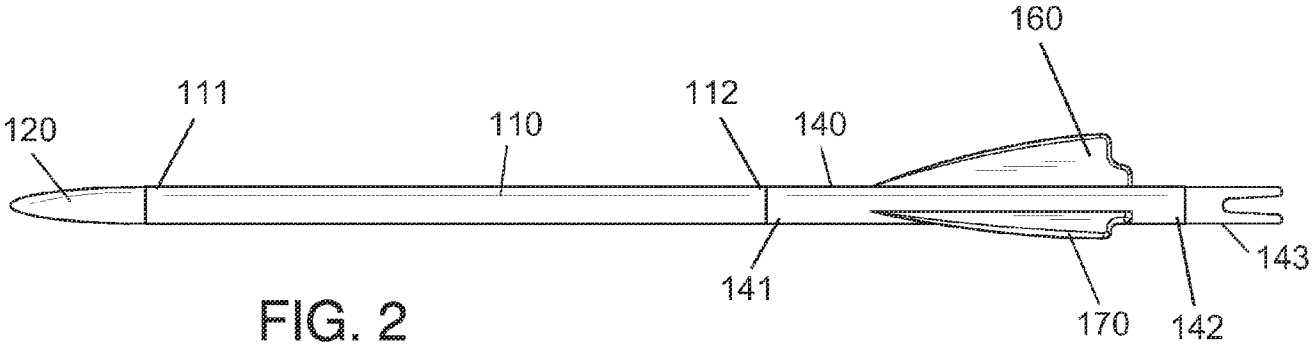
FIG. 2 is a side view of the system of the present invention.
Figure 4:
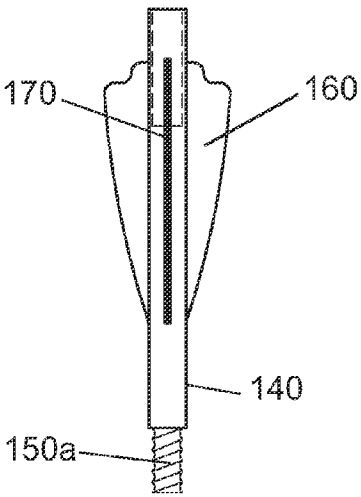
FIG. 4 is a top view of the system of the present invention.
Figure 3:
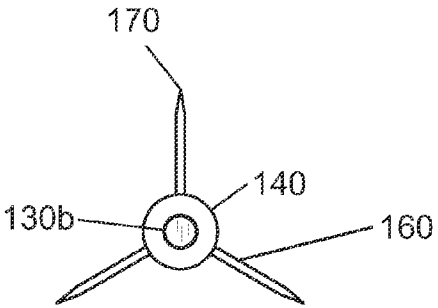
FIG. 3 is a front view of the system of the present invention.
Figure 5:
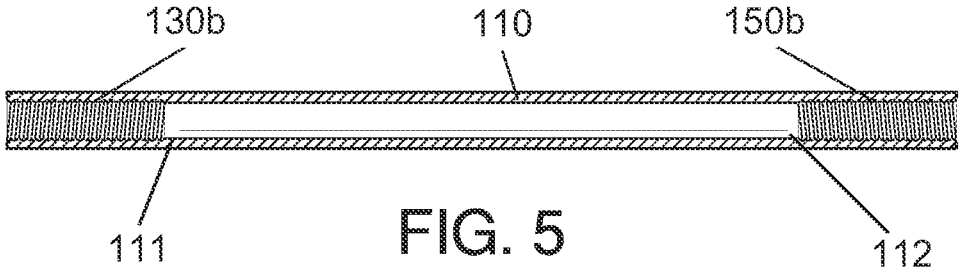
FIG. 5 is a cross sectional view of the system of the present invention.
Figure 6:
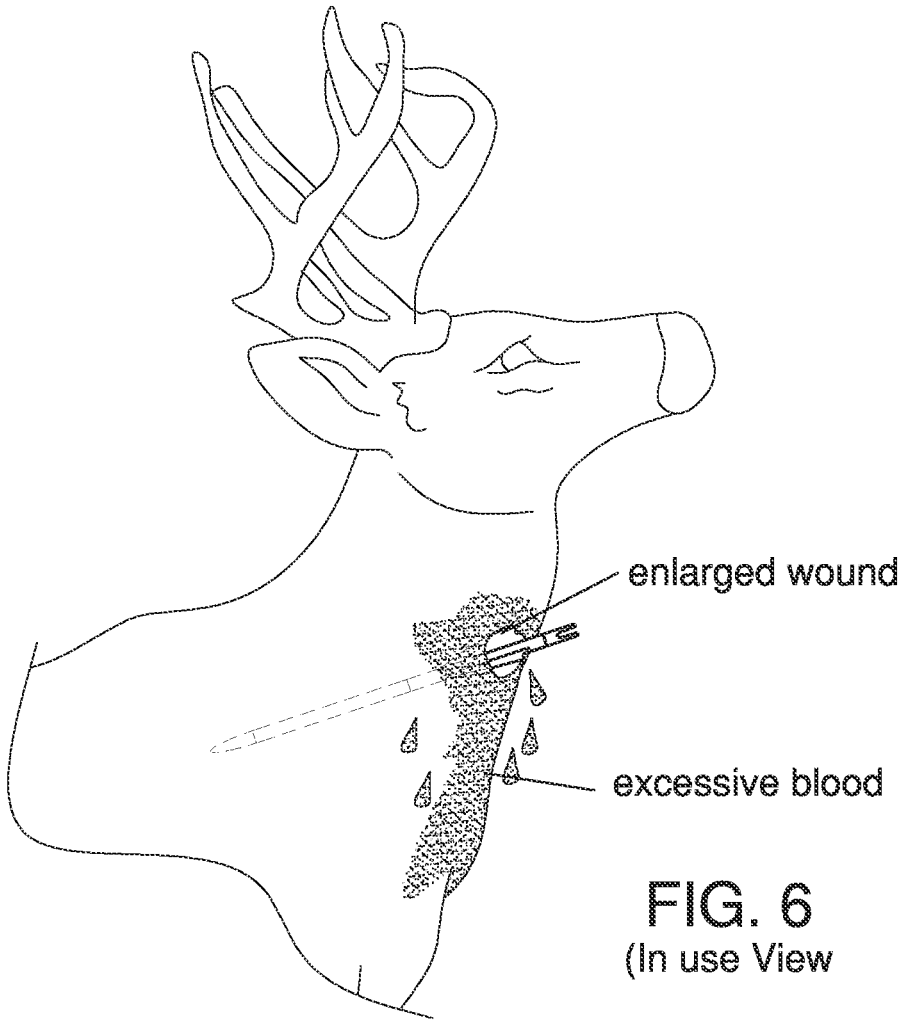
FIG. 6 is an in-use view of the system of the present invention.

Referring now to FIGS. 1-6, the present invention features a novel bolt system 100 (e.g., bolt or arrow for crossbow) for hunting. The system 100 of the present invention produces enhanced wounds, thus reducing kill times.

The system 100 comprises a shaft 110 having a first end 111 and a second end 112. The shaft 110 is generally shorter than standard bolts or arrows. The shaft 110 may be constructed from a variety of materials including but not limited to metal (e.g., aluminum), plastic, wood, the like, or a combination thereof. The shaft 110 may be constructed in a variety of sizes. For example, in some embodiments, the shaft 110 is about 6 inches in length as measured from the first end 111 to the second end 112. In some embodiments, the shaft 110 is between about 4 to 6 inches in length as measured from the first end 111 to the second end 112. In some embodiments, the shaft 110 is between about 2 to 4 inches in length as measured from the first end 111 to the second end 112. In some embodiments, the shaft 110 is more than about 6 inches in length.

The system 100 further comprises an arrowhead component 120 adapted to removably engage the first end 111 of the shaft 110 via a first attachment means. In some embodiments, the first attachment means comprises a screw mechanism. For example, in some embodiments, a male threaded component 130*a* is disposed on the arrowhead component 120 (e.g., the shaft end 122) and a female threaded component 130*b* is disposed in the first end 111 of the shaft 110, wherein the male threaded component 130*a* is adapted to removably engage the female threaded component 130*b*. The first attachment means is not limited to a screw mechanism. For example, in some embodiments, the first attachment means comprises a snap mechanism, a clasp mechanism, a magnet mechanism, a screw mechanism, a latch mechanism, the like, or a combination thereof.

The arrowhead component 120 comprises a pointed end 121 and a shaft end 122, the shaft end 122 engaging the shaft 110. The pointed end 121 is the end for causing a wound in an animal. The arrowhead component 120 may comprise any appropriate design. For example, in some embodiments, the arrowhead component 120 comprises a field point head (e.g., see FIG. 1, bottom, and FIG. 2). In some embodiments, the arrowhead component comprises a broadhead (e.g., with blades, e.g., sharp blades) (e.g., see FIG. 1). Field point heads and broadheads are well known to one of ordinary skill in the art.

The system 100 further comprises a fletch head 140 adapted to removably engage the second end 112 of the shaft 110 via a second attachment means. In some embodiments, the second attachment means comprises a screw mechanism. For example, In some embodiments, a male threaded component 150*a* is disposed on the fletch head 140 (e.g., the shaft end 141) and a female threaded component 150*b* is disposed in the second end 112 of the shaft 110, wherein the male threaded component 150*a* is adapted to removably engage the female threaded component 150*b*. The second attachment means is not limited to a screw mechanism. For example, in some embodiments, the second attachment means comprises a snap mechanism, a clasp mechanism, a magnet mechanism, a screw mechanism, a latch mechanism, the like, or a combination thereof.

The fletch head 140 may be constructed in a variety of sizes. For example, in some embodiments, the fletch head 140 is about 4 inches in length as measured from the shaft end 141 to the back end 142. In some embodiments, the fletch head 140 is less than about 4 inches in length as measured from the shaft end 141 to the back end 142. In some embodiments, the fletch head 140 is more than about 4 inches in length as measured from the shaft end 141 to the back end 142.

In some embodiments, a nock 143 is disposed on the back end 142 of the fletch head 140. Nocks are well known to one of ordinary skill in the art.

Extending outwardly from the fletch head 140 is a plurality of fletchings 160. The fletchings 160 comprise sharp edges 170 so as to enhance the wound in the animal. In some embodiments, the system 100 comprises three fletchings 160 (e.g., see FIG. 3). Fletchings are well known to one of ordinary skill in the art. The fletchings 160 may be constructed from a variety of materials. For example, in some embodiments, the fletchings 160 are constructed from a material comprising titanium or similar material (e.g., for hunting). In some embodiments, the fletchings 160 are constructed from a material comprising plastic (e.g., for practice).

Without wishing to limit the present invention to any theory or mechanism, it is believed that the system 100 of the present invention is advantageous because the system 100 features interchangeable heads. For example, the fletch head is interchangeable with both target and hunting heads.

As used herein, the term "about" refers to plus or minus 10% of the referenced number. For example, an embodiment wherein the shaft 110 is about 5 inches in length includes a shaft 110 that is between 4.5 and 5.5 inches in length. The shaft 110 may be longer.

The disclosures of the following U.S. Patents are incorporated in their entirety by reference herein: U.S. Design Pat. No. D185249; U.S. Pat. No. 4,277,069; U.S. Pat. No. 4,380,340; U.S. Pat. No. 6,186,913; U.S. Pat. No. 6,238,310; U.S. Pat. No. 6,669,585; U.S. Pat. No. 6,705,808.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bolt-arrow system (100) for crossbows, said system (100) consisting of:

(a) a shaft (110) having a first end (111 and a second end (112);

(b) an arrowhead component (120) having a pointed end (121) and a shaft end (122), the shaft end (122) removably engages the first end of the shaft (110), wherein a male threaded component (130*a*) is disposed on the shaft end (122) of the arrowhead component (120) and a female threaded component (130*b*) is disposed in the first end (111) of the shaft (110), wherein the male threaded component (130*a*) is adapted to removably engage the female threaded component (130*b*);

(c) a fletch head (140) having a shaft end (141) and a back end (142), the shaft end (141) removably engages the second end (112) of the shaft (110), wherein a male threaded component (150*a*) is disposed on the shaft end (141) of the fletch head (140) and a female threaded component (150*b*) is disposed in the second end (112) of the shaft (110), wherein the male threaded component (150*a*) is adapted to removably engage the female threaded component (150*b*);

(d) three fletchings (160) extending outwardly from the fletch head (140), wherein each fletchings (160) is a single piece consists of a sharp edge (170), wherein a rear portion of each fletching adjacent to the back end (142) of the fletch head is step-wise shaped, wherein the three fletchings are entirely disposed on the fletch head such that the back end (142) of the fletch head extends beyond the rear portion of each fletching; and (e) a nock (143) disposed on the back end (142) of the fletch head (140).

* * * * *